US006331269B1

(12) United States Patent
Moriceau

(10) Patent No.: US 6,331,269 B1
(45) **Date of Patent: *Dec. 18, 2001**

(54) INERT TANK FOR TREATING OXIDIZABLE LIQUID METAL

(75) Inventor: Jacques Moriceau, Coublevie (FR)

(73) Assignees: Aluminium Pechiney, Paris Cedex; Pechiney Rhenalu, Paris, both of (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/462,083

(22) PCT Filed: Jul. 9, 1998

(86) PCT No.: PCT/FR98/01487

§ 371 Date: Mar. 15, 2000

§ 102(e) Date: Mar. 15, 2000

(87) PCT Pub. No.: WO99/04046

PCT Pub. Date: Jan. 28, 1999

(30) Foreign Application Priority Data

Jul. 16, 1997 (FR) ..... 97 09238

(51) Int. Cl.[7] ..... C21C 7/10
(52) U.S. Cl. ..... 266/207; 266/200
(58) Field of Search ..... 266/200, 207, 266/208, 211

(56) References Cited

U.S. PATENT DOCUMENTS

| | | | | |
|---|---|---|---|---|
| 3,677,332 | * | 7/1972 | Smiernow | 266/208 |
| 3,870,511 | | 3/1975 | Szekely . | |
| 5,894,009 | * | 4/1999 | Luven | 266/211 |

FOREIGN PATENT DOCUMENTS

| | | |
|---|---|---|
| 2815011 | 10/1979 | (DE) . |
| 3904200 | 8/1990 | (DE) . |
| 0063555 | 10/1982 | (EP) . |
| 62-240724 | 10/1987 | (JP) . |

* cited by examiner

*Primary Examiner*—Scott Kastler
(74) *Attorney, Agent, or Firm*—Dennison, Scheiner, Schultz & Wakeman

(57) ABSTRACT

An inert vessel for treating an oxidizable liquid metal includes a vessel body and a lid mounted thereon with bearing surfaces at a junction therebetween, the body and lid each including a metal wall having an inner face coated with a refractory lining. The vessel further includes movable auxiliary equipment passing through the lid, and optionally the body, with the vessel body including inlet and outlet means for the liquid metal and external atmosphere. An inflatable seal is disposed between the lid and the vessel body housed in a peripheral receptacle, the peripheral receptacle including at least one wall which is an extension of the lid, and at least one other wall which is an extension of the vessel body, the seal when inflated directly contacting the wall which is the extension of the lid and the wall which is the extension of the vessel body, and being directly adjacent the vessel body adjacent the junction.

14 Claims, 1 Drawing Sheet

INERT TANK FOR TREATING OXIDIZABLE LIQUID METAL

FIELD OF THE INVENTION

The present invention relates to a treatment vessel for liquid metal that is easily oxidable, said vessel comprising one or more devices to prevent gases that are harmful to the liquid metal or apparatuses in the vessel from entering the vessel, said vessel therefore being inert. Harmful gases generally contain oxygen and/or water vapor.

DESCRIPTION OF RELATED ART

Before casting oxidable liquid metals (particularly aluminum, magnesium or their alloys) into semi-finished products it is essential that they be treated so as to degas them (particularly of hydrogen) and/or to eliminate the alkalines or inclusions (particularly solid inclusions resulting from when the metals were oxidized).

The treatment in particular comprises blowing gas into the liquid metal (the gas, that is generally argon to which chlorine gas may or may not have been added, is blown using a dispersion rotor immersed in the liquid metal, the drive shaft and the turbine of the rotor being usually graphite) and/or simply filtering the metal through a bed of filtering material, for example a porous ceramic part or any other filtering medium.

Obtaining a low hydrogen content is crucial for certain metals and is always preferable for most other metals in order to avoid deterioration of mechanical properties. Mechanisms for regassing the liquid metal with the hydrogen that results from said metal reducing the water vapor contained in the surrounding atmosphere can restrict the degassing results.

Similarly, the absence of inclusions that results, in particular, from the liquid metal being oxidized by the oxygen in the air and/or water vapor is often essential in order to avoid defects in parts obtained subsequently, for example thin strips.

Contact between liquid metal and oxygen in the air and water vapor may also have the following consequences:

- major melt loss with risk of the alloy composition becoming modified,
- risk of plenty of solid dross forming thick layers that could contaminate the metal and be detrimental to the quality of the cast metal and that could erode the shaft of the rotor used to blow the gases, whereas the object is to eliminate the dross,
- also the oxidable parts in said treatment vessel becoming prematurely worn by being oxidized, particularly said rotor shaft that is generally graphite.

It is therefore vitally important to avoid any contact between the liquid metal being treated and the surrounding temperature and/or the water vapor, for example during the periods when a constant temperature is maintained between two treatments, in order to improve the performance of the treatment vessel and the quality of the treated metal.

To achieve this aim European Patent EP 216393 and American Patent U.S. Pat. No. 3,870,511 describe maintaining or circulating a light gas flow with a low water or inert gas content, for example argon or similar gas, on the surface of the metal under the lid of the treatment vessel that comprises a leaktight seal. A device of this kind is, however, expensive in terms of the quantity of inert gas it consumes and is insufficiently effective. In particular only the surface of the bath is inert. Furthermore, the standard devices used to ensure a leaktight seal on the vessel are generally difficult and expensive to implement and use if they are to be efficient at preventing incoming air.

German patent DE 4307867 describes protecting liquid metal by creating a vacuum in the vessel. This solution is, however, expensive and difficult to implement and use and could even cause incoming air to enter the vessel.

Japanese patent application JP 62 240724 (Showa) describes a treatment vessel (1) and lid (10); leaktightness between the vessel and the lid is ensured by a projection (13) located on the periphery of lid (10) and embedded in a bath of sand (9) that is contained in a matching trough (8), said trough being located on the periphery of the upper section of vessel (1), and by a seal (12) capable of withstanding the heat between lid (10) and the top of the vessel (11). A leaktight device of this kind is not particularly simple to install or operate and the fact that it has two seals means that neither of the seals is sufficient on its own. Furthermore, there is a risk of the liquid metal becoming contaminated by the sand.

Also a pressurized gas box (22) is used to ensure leaktightness of the gas-blowing rotor (4) through the lid. This has the drawback of consuming gas and requiring the device to be monitored.

German patent application DE 2815011 describes a device for ensuring leaktightness in the vacuum of a melting vessel, the device comprising an inflatable tube (16) that operates in conjunction with an elastic leaktight strip (17) located on the periphery of said inflatable joint and that is pressed against the inner surface of trough (21) to ensure leaktightness of the vessel, the joint that ensures the compression being trapped in a receptacle closed by flange (18). Once again this composite leaktightness device is not particularly easy to produce or operate as it is designed to maintain a vacuum.

Another known method of protecting the surface of liquid metal uses a flux of melted salt. This protection is, however, imperfect due to the surface waves caused by the degassing treatment and the risk of inclusions being introduced into the liquid metal. Furthermore, the flux also has to be treated.

The applicant has, therefore, sought an inert vessel that prevents any damaging contact between the liquid metal and the external atmosphere, the vessel being just as compact as standard vessels and even more economical and easier to install and operate.

Also a number of types of vessel are known for treating oxidable liquid metals either continuously or semi-continuously.

These vessels comprise a vessel body that mainly consists of an outer steel shell the inner surfaces of which are lined with refractory brickwork that is relatively porous and that is as inert as possible relative to the metal being treated. The inner layout depends on the treatment(s) to which the metal is subjected.

The vessel brickwork described above can be divided into compartments using dividing walls also made of inert refractory brickwork.

The brickwork is at least partly made with mortar and refractory insulator. The shell comprises a plurality of holes to evacuate the water vapor and drying gases and to avoid the refractory brickwork from becoming distorted when they are dried and baked. The holes are also used to evacuate part of the water vapor that is taken up by the refractory lining and/or insulators or more generally by the lining coatings when the vessel is stopped or drained, another part of the vapor being able to pollute the metal treated in the vessel.

But when, on the other hand, the vessel is stopped the holes play a major part in the linings' recapturing humidity, humidity that will then be at least partly released into the treated metal and damage the quality, as described above.

The vessels also comprise a lid through which equipment passes that is necessary to the treatment method, said equipment often being removable, i.e. it can be removed from the vessel, and/or is movable. In particular, the equipment comprises means for injecting the treatment gas, usually dispersion turbines located at the end of a rotor shaft; the rotor as it is may pass through the lid or it may sometimes be covered with a fixed sheath, all the equipment being removable; the equipment can also comprise means for heating the liquid metal, for example an immersion or similar heater that can be removable and that is partly immersed in the liquid metal, or means for measuring the temperature (thermocouple).

Similarly to the lid, the vessel body comprises a metal outer surface that can be perforated, the inside of which is lined with refractory lining. There is generally a clearance between the lid and the surface of the liquid metal.

The vessels also comprise inlet and outlet means for the liquid metal that may be such that they avoid any contact between the metal treated in the vessel and the external atmosphere. These means are generally "underpouring" or "by siphon" or similar means, or the liquid metal itself may ensure the leaktightness and insulation inside the vessel from outside.

The base of the vessel body may include a drainage hole that passes through the surface and that can be sealed by a removable plug.

All of this auxiliary equipment could cause unwanted introduction of damp air that could be harmful to the metal being treated. They should therefore be avoided.

SUMMARY OF THE INVENTION

The invention relates to an inert vessel for treating an oxidable liquid metal, including a vessel body onto which a lid is mounted, said body and lid each including a metal wall the inner surface of which is covered with an inert refractory lining, a plurality of holes being pierced in the wall of the vessel body and, optionally, in that of the lid, removable and/or movable or possibly fixed auxiliary equipment that passes through the lid and, optionally, through the vessel body, said equipment being used to perform or control said treatment, the vessel body including inlet and outlet means for the liquid metals such that they avoid any contact between the liquid metal located in the vessel and the external atmosphere, preferably using a liquid metal- or similar siphon, said vessel being optionally fitted with a pressure regulating device for adjusting the internal pressure to a value higher than the atmospheric pressure and being characterized in that it includes at least two of the following devices:

a) a leaktight shell that encloses the metal wall of the vessel body and optionally the lid if it includes holes, said shell being separated from said wall by a space containing dry gas that is preferably inert, b) an inflatable seal between the lid and the vessel body, c) leaktightness means for all the removable and/or movable auxiliary equipment that passes through the lid and optionally through the vessel body.

The leaktight shell, which is generally steel, is hermetically sealed. It may comprise several parts that are assembled using seals. The double shell thus obtained contains dry gas that is preferably inert, for example nitrogen or argon. The gas may be flowing slightly, in which case the shell includes at least one gas inlet and outlet that are generally calibrated and/or sealable, or it may be static, the pressure of which being controlled such that it is slightly higher than the atmospheric pressure.

The vessel may include a drainage tap located at the bottom of the body or lid to evacuate condensation coming from the refractory lining and passing through the holes in the surface.

The inflatable peripheral joint used to create leaktightness between the vessel body and lid includes a simple elastomer tube that is heat-resistant and that is inflated, using a gas that is preferably neutral, to a suitable pressure relative to the weight of the lid and to the condition of the bearing surfaces to be made leaktight.

A device of this kind is an important means of the invention and proves particularly efficient while being economical and easy to implement and use ; it enables the inside of the vessel and the liquid metal bath to be isolated from the external atmosphere safely as it can be perfectly shaped to the bearing surfaces that form parts of the lid and vessel body to be made leaktight, said surfacesgenerally being irregularly shaped with warped profiles, unsatisfactory evenness and easily distorted; the device alone enables the vessel to be inert to a high degree.

Moreover, the lid, that is simply placed on the inflatable seal and the weight of which creates a leaktight contact, is easily, quickly and automatically remote-controlled and therefore avoids any risk for the operator.

According to the invention it may sometimes be advantageous for the inert vessel to at least include this double shell that avoids humidity being taken up by the refractory brickwork when the vessel is stopped and drained, and that also avoids said humidity subsequently polluting the metal being treated when the humidity is released. Inertness in the vessel is further improved when the vessel itself is fitted with an inflatable seal and/or means for ensuring leaktightness when auxiliary equipment passes through the vessel.

In order to obtain the best results the vessel should preferably remain closed during said temperature maintenance and/or drainage operations.

The auxiliary equipment used to perform and control the liquid metal treatment is generally removable, i.e. they can be handled through the lid or the vessel body to be positioned or removed from the liquid metal using lifting devices. The equipment usually concerns devices for supplying the treatment gas, for example the drive shaft of the rotor turbine, devices for heating the liquid metal, for example semi-immersed immersion heaters, or devices for measuring temperature, for example semi-immersed thermocouples. Removable equipment that passes through the vessel body usually concerns a drainage hole that is sealed using a plug actuated using an operating rod.

Said equipment can also be movable, for example the rotating shaft of the gas injector when it is not protected by a fixed protective sheath.

When this removable and/or movable equipment passes through the lid or the vessel body leaktightness is advantageously ensured by a stuffing box or similar device generally including

- a flange surrounding said equipment and fastened, for example by being welded, to form a leaktight contact with the lid, the vessel body or the double shell in which they are enclosed and in which a receptacle is provided for the leaktight lining that surrounds, and that is of suitable measurements for, said movable equipment.

a leaktight lining, generally a graphite-based braid positioned in said receptacle that encloses said equipment, a counter-flange that also surrounds the equipment and that includes means that enable said lining to be compressed against the surfaces of said receptacle and said removable and/or movable equipment using gripping devices that operate in conjunction with said flange that forms parts of the lid or vessel body.

In order to facilitate dismantling and maintenance the flange and stuffing box can also be fastened to the lid or vessel body such that they are removable yet leaktight using a seal and gripping means. They are fastened to a first flange which in turn is fastened, for example by being welded, directly on to said cover or vessel body such that it is leaktight.

Given that this device is leaktight in both directions it is effective at isolating the liquid metal from the external atmosphere, particularly when there is an excess of gas pressure in the vessel or when the pressure accidentally drops due to unexpected cooling of the vessel.

Leaktightness is ensured in the standard way when fixed equipment passes through the lid or vessel body: the equipment is fastened to a counter-flange using a seal, said counter flange being fastened or welded such that it is leaktight to the lid or vessel body.

The pressure regulating device inside the vessel usually includes inlet and outlet pipes for gas that passes through the lid, said pressure regulating device operating with dry gas such as dry air, nitrogen or argon. The outlet pipe, which is generally fitted with a valve for regulating pressure, can also be used to evacuate the treatment gases introduced into the liquid metal.

The pressure regulating device can also be used to introduce a flow of inert gas that flows over the surface of the liquid metal being treated or to maintain the gas in the vessel dry and inert.

It also includes a standard feedback loop for regulating pressure that compares the pressure in the vessel to the setpoint value and that activates the regulating valves located on the gas inlet and outlet pipes according to the result of the comparison. It can also combine regulating the gas flow.

The device is particularly effective when used in addition to the leaktightness devices of the lid that prevent the surface of the liquid metal from being contaminated and the oxidable equipment, for example made of graphite, from combusting or from becoming prematurely worn.

It is advantageous to equip said devices with their own leaktightness means, for example sealing valves, in order to protect the inside of the vessel from the external atmosphere when the level of liquid metal is too low to ensure leaktightness of the inlet and outlet "underpouring" or similar devices, particularly during drainage and filling operations of the vessel.

In order to obtain the best degree of inertness in the vessel it is particularly advantageous to combine some or all of the means to which the invention relates.

DESCRIPTION OF THE PREFERRED EMBODIMENTS

Figure 1:
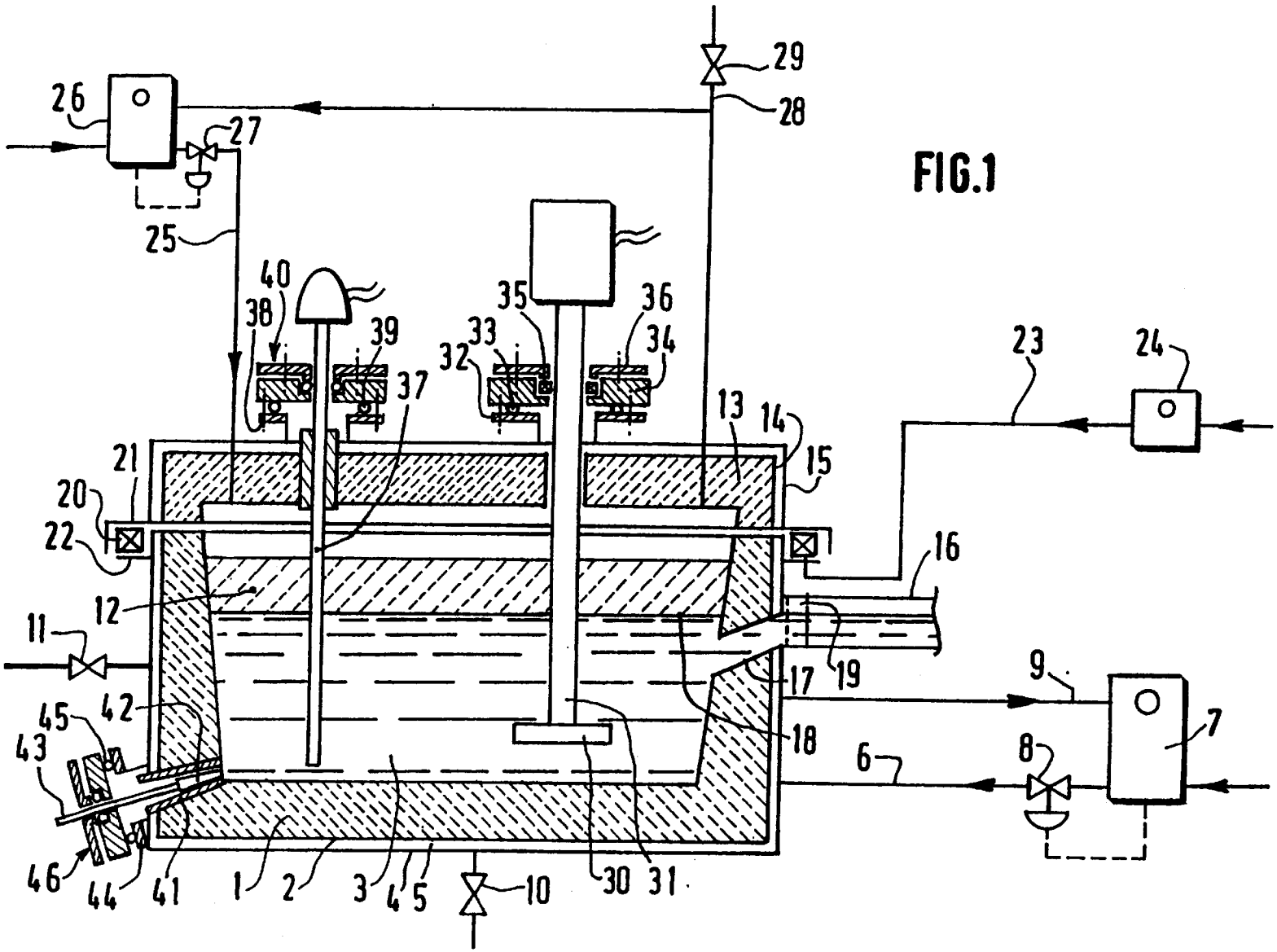
FIG. 1 is a drawing of an inert vessel treatment assembly including a gas injector that uses an immersed rotor and auxiliary equipment; the vessel includes several inerting means of the invention.

The vessel therefore includes a double outer shell, an inflatable seal between the lid and the vessel body, stuffing box or similar leaktightness means on the removable and/or movable equipment that passes through the lid and the vessel body and a pressure regulating device inside the vessel.

(1) shows the refractory lining of the vessel body that lines the inside of metal wall (2) and that contains liquid metal (3). Metal wall (2) is pierced with a plurality of holes (not shown) that enable the water vapor to evacuate from the refractory lining when it dries; said metal wall is enclosed within a shell (4) to constitute a double shell; the inner space (5) of this double shell contains dry gas at a higher pressure than the atmospheric pressure to prevent the external atmosphere from coming into contact with the refractory lining and possibly polluting the liquid metal.

The dry gas is introduced in the double shell (5) by a tube (6) using an automatic pressure regulating device (7) that actuates valve (8), the pressure being measured by a circuit (9).

The lower section of outer shell (4) includes a branch pipe (10) equipped with a valve to evacuate water condensation.

(11) is a gas outlet device equipped with a valve that can be used to create a gas flow in the double shell and to evacuate the water vapor that is produced when the refractory lining is dried.

The interior of the vessel is divided into compartments by a dividing wall (12) made of refractory lining.

Like the vessel body the lid includes a refractory coating (13), provided on the inner surface of metal wall (14), that is itself surrounded by a shell (15), to obtain a double shell filled with gas; the gas supply device is not shown and can be identical to that in the vessel body.

The "underpouring" or similar inlets and outlets for the liquid metal, in which the liquid metal itself ensures isolation between the interior of the vessel and the external atmosphere, can be identical.

A single example of this inlet/outlet device is shown.

The device includes a channel (16) for supplying liquid metal and a sloping shaft (17) that is cut into the surface of the vessel body such that the aperture that opens into the vessel is located under level (18) of the liquid metal under normal operating conditions.

A movable or adjustable leaktight sealing valve (19) may also be included in the event of the level of metal in the vessel being insufficient or in the absence of said metal, for example during drainage or filling operations.

The vessel is closed using a peripheral inflatable seal (20) that ensures the inside of the vessel is insulated and that enables it to be put under pressure.

The seal is housed in a receptacle that is also peripheral, at least one wall (21) of which (there are two in the present example) forms part of the lid and is used to bear the seal and at least one other wall (22) of which (there are two in the present example) forms part of the vessel body and is also used to bear the seal.

The cross section of the receptacle is quadrilateral but it could also be of a different shape, for example circular.

The inflatable seal is generally made of flexible elastomer that is heat-resistant. Advantageously, it has a rectangular cross section that provides better contact with the bearing surfaces and better leaktightness.

Leaktightness is obtained by the seal being inflated, generally with nitrogen, said seal then pressing against the surfaces of the receptacle thereby acting as a sealing surface.

A device of this kind is particularly suitable as it takes into account the lack of evenness in said sealing surfaces or the defects in measurements in the receptacle. The device is able to overcome these defects, that are common in large-size vessels, even when the defects are accentuated or modified due to the vessel being subjected to repeated heating and cooling cycles.

The inflatable seal is supplied with gas by pipe (23) using pressure regulator (24).

The pressure regulating device inside the vessel includes a supply pipe (25) connected to a gas pressure regulator (26) that operates with valve (27).

Outlet pipe (28) is used both for the regulator (26) to measure the pressure and to evacuate the gases used to treat the liquid metal; the outlet pipe is equipped with an adjustable valve (29).

A gas flow regulator can be coupled with gas pressure regulator (26) if the surface of the liquid metal is to be swept by an inert gas during treatment or more generally inside the vessel while a higher pressure than the atmospheric pressure is maintained.

The equipment that passes through the lid mainly includes a gas injection rotor including a turbine (30) immersed in the liquid metal and that is driven by a shaft (31).

The leaktight device includes a first flange (32) fastened in a leaktight manner, for example by welding or using a seal etc., to the lid to which a stuffing box is joined with a leaktight seal (33), said stuffing box including a flange or a ring-shaped part (34) that surrounds shaft (31) and that is sufficiently thick to contain a circular receptacle suited to the diameter of the shaft and in which a braid (35) is positioned that is compressed by the counter-flange or special ring (36) bolted onto part (34).

This leaktight device enables the shaft to revolve and allows the height of the shaft to be adjusted or the shaft to be removed from the vessel.

The other removable equipment that passes through the lid includes a immersion heater or similar heating element (37) one end of which is immersed in the liquid metal, the other end of which projects out of the vessel. Similarly to the rotor shaft, the leaktightness when the equipment passes through the lid is ensured by a leaktightness device including a first flange (38) fastened to form leaktight contact with the lid to which a stuffing box (40) is joined with a leaktight seal (39), as described above (34–35–36) for rotor shaft (31).

Thermoelectric couples or any other equipment (not shown) can also be installed to be either fixed or removable according to the invention.

Equipment that passes through the surface of the vessel body includes the drainage hole including a conduit (41) that is sealed by a plug (42) that is operated by a rod (43).

In order for rod (43) to be leaktight the same devices can be used as for the immersion heater, for example a first flange (44) that surrounds the outer aperture of conduit (41) onto which the stuffing box device (46) is joined by a seal (45) to ensure leaktightness of the operating rod (43), as described above.

The stuffing box seals or braids are generally graphite-based but can also be toric seals made of the usual elastomer providing it can withstand the temperature of the flanges onto which it is fitted. Inflatable seals or any other suitable technique may also be used.

This example of the invention may also be applied to liquid metal filtering treatment vessel or a mixed gas and filtering treatment vessel.

Advantages of the Invention

The invention enables improved and more complete degassing of metal by avoiding any contact with water vapor which could result in the metal becoming regassed or coming into contact with the air which could pollute the metal.

This contact could occur on the free surface of the metal and at the interface between said metal and the lining, the porosity of which is equal to several percents. It is for this reason that it is advisable to use a double-shelled vessel in addition to the inertness of the liquid metal surface as a result of using an inflatable seal and, optionally, excess pressure in the vessel. Said double-shelled vessel avoids any harmful humidity or air from being diffused through said lining, inertness being further improved by making the removable and/or movable auxiliary equipment leaktight when it passes into the vessel.

The invention also prevents consumable parts, for example graphite parts, from becoming prematurely worn due to oxidation. In the event of absence of inertness the temperature is approximately between 500 and 700° C. in the space located above the liquid metal and is easily promotes oxidation by the air that may be in the space and that can be renewed by natural convection.

It has often been reported in the past that it is necessary to send a flux of inert gas near the graphite rotor shaft to limit the oxidation and avoid breakage.

The inertness devices of the invention enable the space above the liquid metal to be insulated, particularly using the seal between the vessel body and the lid. The seal is advantageously complemented with the leaktightness devices of the auxiliary equipment and/or the pressure regulating device that prevent any oxygen and water vapor from being present. Excessive oxidation of the liquid metal no longer occurs as it has been possible to reduce the quantity of dross forming significantly, such that it is practically no longer necessary to perform operations to eliminate the dross, irrespective of the conditions under which the vessel is used.

Similarly, the hydrogen rate of said metal is low and remains low.

Also, vessels equipped with devices according to the invention are easily and quickly installed and operated, said operation work, for example displacing the lid, can be entirely performed by remote control.

What is claimed is:

1. An inert vessel for treating an oxidizable liquid metal, comprising:

a vessel body and a lid mounted thereon with bearing surfaces at a junction therebetween, the body and lid each including a metal wall having an inner face coated with a refractory lining, the vessel body and optionally the lid having a plurality of holes therethrough, movable auxiliary equipment passing through the lid, and optionally, auxiliary equipment passing through the body, the vessel body comprising inlet and outlet means for the liquid metal including means for isolating liquid metal within the vessel from external atmosphere, an optional pressure regulating means for adjusting pressure within the vessel to higher than atmospheric pressure, and an inflatable seal disposed between the lid and the vessel body housed in a peripheral receptacle, said peripheral receptacle comprising at least one wall which is an extension of the lid, and at least one other wall which is an extension of the vessel body, said seal when inflated being directly adjacent the vessel body adjacent the junction and directly contacting the wall which is the extension of the lid and either the wall which is the extension of the vessel body or the vessel body itself or both the wall which is the extension of the vessel body and the vessel body itself.

2. The inert vessel of claim 1, wherein said seal has a rectangular cross section.

3. The inert vessel of claim 1, further comprising at least one of the means:

a) a sealing shell means surrounding the metal wall of the vessel body, and optionally surrounding the lid when the lid has holes therethrough, said shell being separated from said wall by a space containing a dry gas; and b) leaktight means for said auxiliary equipment.

4. The inert vessel of claim 3, wherein a lower section of the sealing shell includes a branch pipe for evacuating water vapor condensation.

5. The inert vessel of claim 3, wherein the leaktight means comprises stuffing boxes including a flange fastened in a leaktight manner to the lid or vessel body, said flange including an annular receptacle around said equipment, a leaktight lining in said receptacle and a counter flange including means for compressing said lining and including a gripping means acting in conjunction with said flange.

6. The inert vessel of claim 15, wherein said flange includes a weld or fastening including a leaktight seal and gripping means for fastening said flange to a second flange welded to form a leaktight seal with said body, said lid or said sealing shell.

7. The inert vessel of claim 1, wherein said auxiliary equipment includes at least one of a rotor for introducing treatment gas into the liquid metal, at least one heating element, a thermocouple and a means for draining the vessel.

8. The inert vessel of claim 5, wherein the leaktight seals are graphite based.

9. The inert vessel of claim 5, wherein the leaktight lining is graphite based.

10. The inert vessel of claim 1, wherein the inlet and outlet means comprise means for isolating the vessel from external atmosphere by interposing liquid metal therebetween.

11. The inert vessel of claim 10, wherein the means for isolating comprises an aperture for liquid metal disposed in the vessel body at a level such that it is under the liquid metal which passes through the aperture.

12. The inert vessel of claim 1, wherein the inlet or outlet means include an adjustable leaktight sealing valve which seals the inlet or outlet means when insufficient metal is present to fill the inlet or outlet means.

13. The inert vessel of claim 1, wherein the seal when inflated contacts the vessel wall adjacent the junction.

14. The inert vessel of claim 10, wherein the isolating means is an underpouring or siphon means.

* * * * *

UNITED STATES PATENT AND TRADEMARK OFFICE

CERTIFICATE OF CORRECTION

PATENT NO. : 6,331,269 B1
DATED : December 18, 2001
INVENTOR(S) : Jacques Moriceau It is certified that error appears in the above-identified patent and that said Letters Patent is hereby corrected as shown below:

Column 9
Line 25, change "15" to -- 5 --.

Signed and Sealed this

Nineteenth Day of March, 2002

*Attest:*

*Attesting Officer*

JAMES E. ROGAN
*Director of the United States Patent and Trademark Office*